US006142646A

United States Patent [19]

Liu

[11] Patent Number: 6,142,646

[45] Date of Patent: Nov. 7, 2000

[54] LIGHT SOCKET ASSEMBLY

[76] Inventor: Chun Ming Liu, No. 30, Kwo-Fong Road, Hsinchu, Taiwan

[21] Appl. No.: 09/243,430

[22] Filed: Feb. 3, 1999

[51] Int. Cl.[7] ..... H01R 17/00

[52] U.S. Cl. ..... 362/226; 439/619; 439/699.2

[58] Field of Search ..... 362/226, 249; 439/375, 619, 699.2

[56] References Cited

U.S. PATENT DOCUMENTS

| | | | |
|---|---|---|---|
| 4,219,870 | 8/1980 | Haraden et al. | 362/226 |
| 4,376,967 | 3/1983 | Hough | 362/226 |
| 5,620,343 | 4/1997 | Pan | 439/699.2 |
| 5,701,015 | 12/1997 | Lin | 362/226 |
| 5,791,940 | 8/1998 | Chen et al. | 439/619 |
| 5,795,189 | 8/1998 | Liou | 439/699.2 |
| 5,989,068 | 11/1999 | Shu | 439/619 |

*Primary Examiner*—Alan Cariaso
*Attorney, Agent, or Firm*—Rosenberg, Klein & Lee

[57] ABSTRACT

The object of the present invention discloses a light socket assembly, which comprises a light bulb; a base having an circular end to connect said light bulb and a hollow-flat-shape end on the other end; a housing to properly cover said base having a circle end and a rectangle end including two segment groove in two opposite walls and two flat grooves in another opposite walls; and optionally a mounting pin having an open end for mounting said hollow-flat-shape end of base and a longitudinal concave surface on opposite sides of an erected post.

2 Claims, 5 Drawing Sheets

LIGHT SOCKET ASSEMBLY

BACKGROUND OF THE APPLICATION

The conformation of the light socket for outdoor-usage light string is quite different from that for indoor-usage. The light socket for indoor-usage provides minimal protection against moisture, and thus can not be used outdoors. There is a known conventional water-proof light socket showing in FIG. 1, in which a base (11) has a protractile separation plate (12) extended thereof to separate the end of said base as two portions to isolate the power wires. Although this conformation of the light socket can protect the light string from moisture, formation of a mold for this conformation is rather difficult and thus increases the cost. Therefore, it is not practical to use such light socket for indoor-application. Furthermore, there is a need to develop a light socket for both indoor- and outdoor-usage in a lower cost.

SUMMARY OF THE APPLICATION

The object of the present invention discloses a light socket assembly, which comprises a light bulb; a base having an circular end to connect said light bulb and a hollow-flat-shape end on the other end; a housing to properly cover said base having a circle end and a rectangle end including two segment groove in two opposite walls and two flat grooves in another opposite walls; and optionally a mounting pin having an open end for mounting said hollow-flat-shape end of base and a longitudinal concave surface on opposite sides of an erected post.

The present invention also relates a light socket wherein the light socket does not include the mounting pin.

The present invention also discloses a light socket wherein the rectangle end of the housing is slant from the outer rim downward to the center.

In the round orifices on the rectangle end of said housing, circumscribed by one longitudinal concave surface of the mounting pin and one segment groove on the rectangle end, the power wires are firmly restricted therein to prevent the moisture. Additionally, the mounting pin can be taken off in the indoor-application of the light string. The presented light socket not only simplify the assembly of the indoor-usage light string, but also reduce the cost because only one mould is needed to manufacture the light string used in both outdoor and indoor.

DETAILED DESCRIPTION OF THE PREFERRED EMBODIMENT OF THE INVENTION

Figure 1:
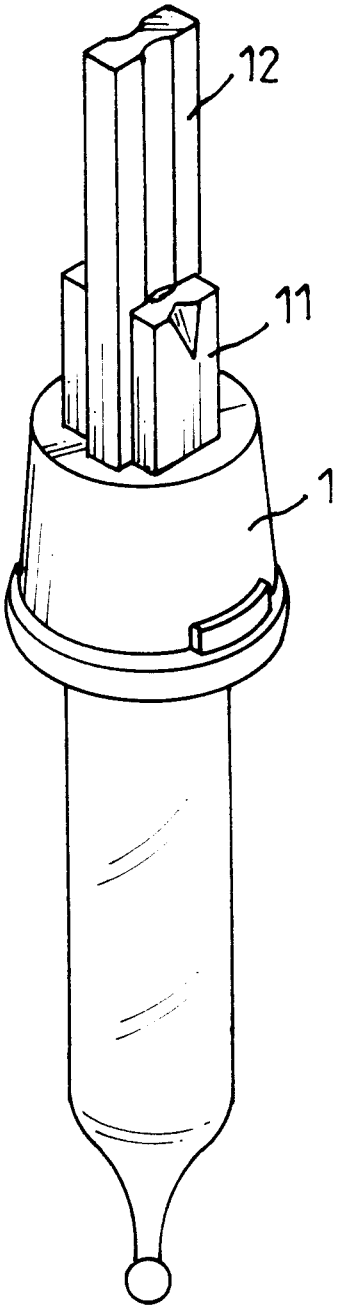
FIG. 1 (prior art)
FIG. 1 is an elevation front view of the conventional light socket.
Figure 2:
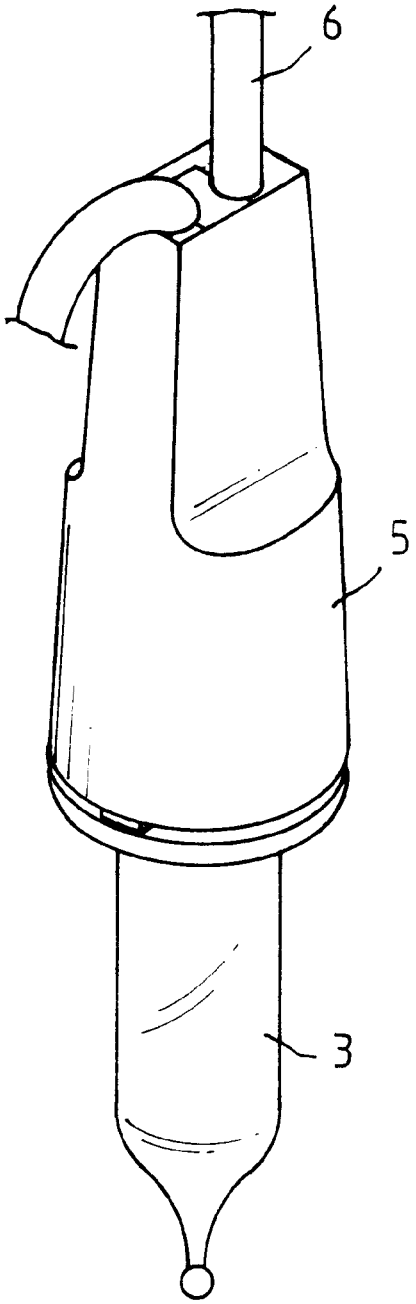
FIG. 2 is an elevation front view of the present invention.

One embodiment of the presented light socket is shown in FIG. 2. The power wires are extended from the rectangle end of the housing (5) having a slant plane from the outer rim downward to the center of the rectangle. Each power wire is firmly restricted in a round orifice circumscribed by one longitudinal concave surface of the erected post of the mounting pin and one segment groove on the slant plane of the rectangle end of said housing.

Figure 3:
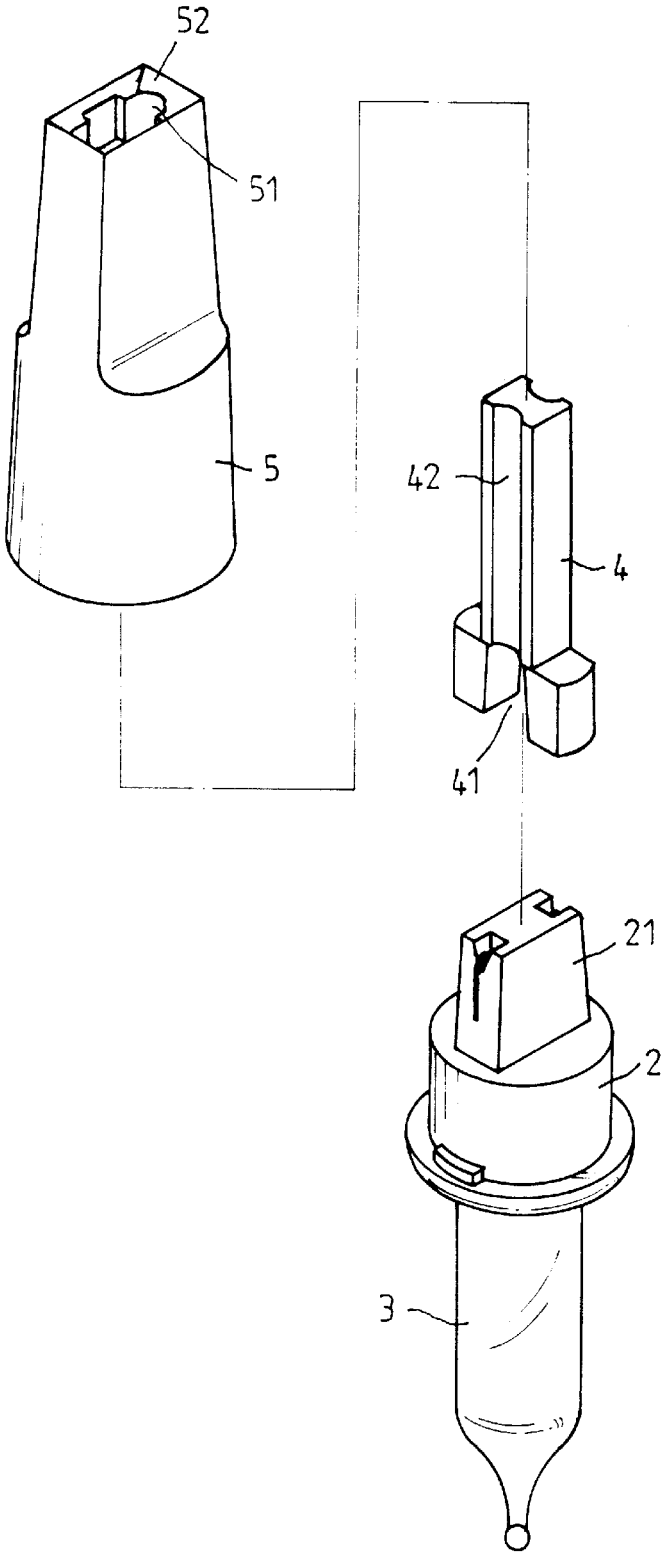
FIG. 3 is an elevation view of the present invention wherein each means is separated.

FIG. 3 further demonstrates the conformation of the presented light socket. The light bulb (3) is fixed on the circular end of the base (2), and the hollow-flat-shaped end (21) of said base (2) is mounted to the open end (41) of the mounting pin (4). The erected post of said mounting pin (4) has two longitudinal concave surfaces (42) on opposite sides. Finally, the housing (5) having one circle end and one rectangle end properly covered the base (2) together with the mounting pin (4). The rectangle end includes two segment grooves (51) in two opposite walls and two flat grooves in another opposite walls, and the rectangle plane 52 is slant from the outer rim downward to the center.

Figure 4:
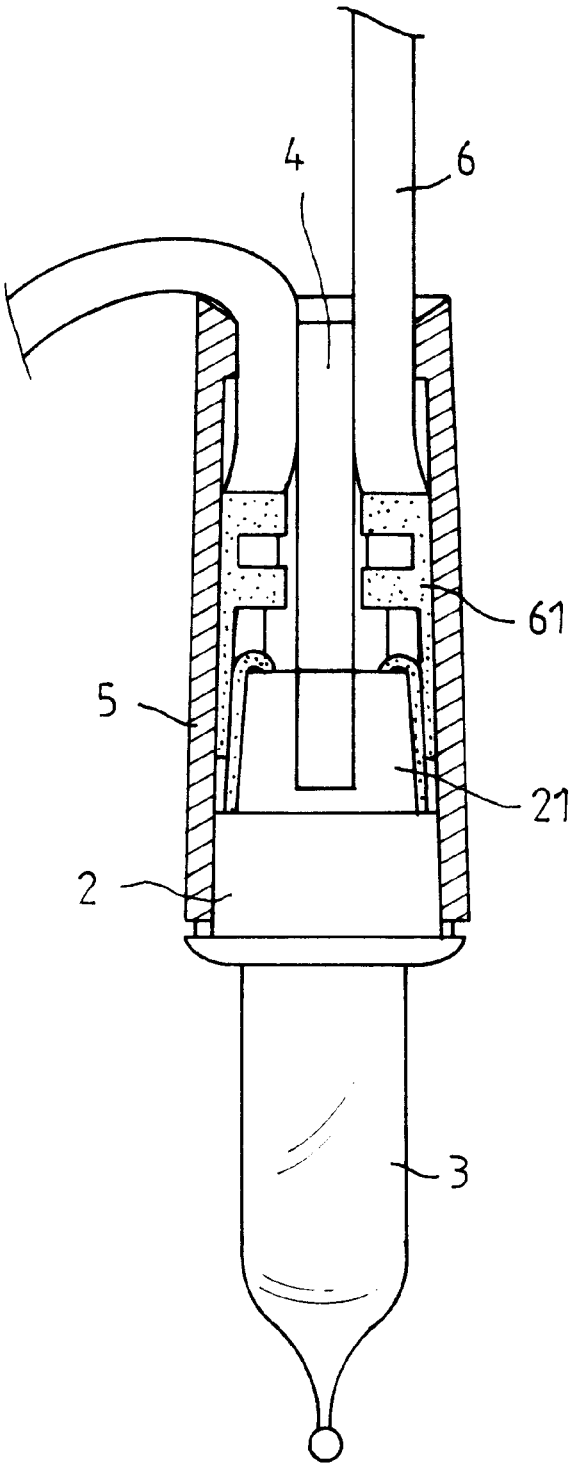
FIG. 4 is a perspective view of the present invention wherein the mounting pin is inserted therein.
Figure 5:
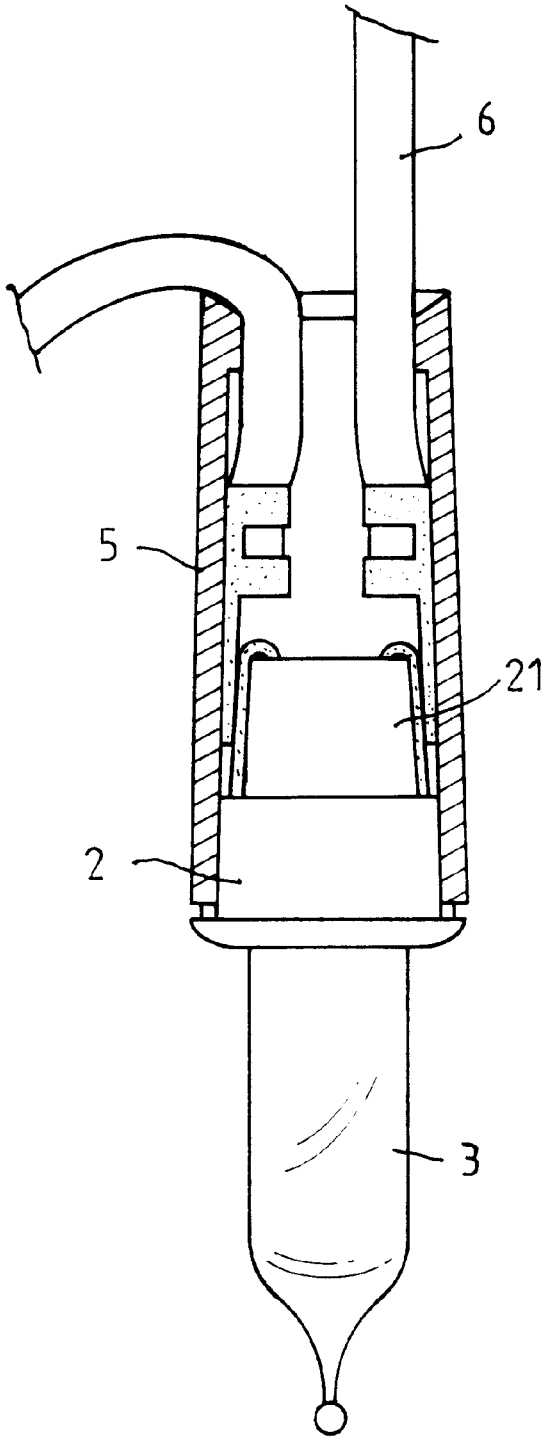
FIG. 5 is a perspective view of the present invention wherein the mounting pin is taken off.

FIGS. 4 and 5 illustrate the perspective view of the presented light socket with and without the mounting pin, respectively. The mounting pin is inserted for isolating the power wires when the light string is in outdoor-application, and the conformation of the housing can seal the base and mounting pin completely to against the moisture. Alternatively, the mounting pin can be taken off easily when the light string is in indoor-application.

Although the present invention has been explained in relation to its preferred embodiment, it is to be understood that many other possible modifications and variations can be made without departing from the spirit and scope of the invention hereinafter claimed.

I claim:

1. A light socket assembly, comprising:

a light bulb having a pair of leads;

a base having an open end for receiving said light bulb therein and an opposing end with a hollow polygonal structure extending therefrom, said pair of leads of said light bulb passing through said hollow polygonal structure and respectively exiting from a pair of openings formed adjacent respective opposing lateral ends thereof, said hollow polygonal structure having substantially flat opposing sides extending between said lateral ends;

a housing having a cavity formed therein and open to a circularly shaped end thereof for receiving said base therein and an opposing rectangularly shaped end, said rectangularly shaped end having a bore formed therein in open communication with said cavity;

a pair of lead wires extending into said cavity through said bore for respective coupling to said pair of leads of said light bulb; and, a mounting pin having an opening formed in one end thereof for receiving a portion of said hollow polygonal structure therein to releasably couple said mounting pin to said base, said opening having a pair of side walls respectively overlaying said substantially flat sides of said hollow polygonal structure, said mounting pin having a longitudinally extended distal end portion extending into said bore between said pair, of lead wires to tightly engage said lead wires within said bore and seal said rectangularly shaped end against moisture, said distal end portion of said mounting pin having a pair of longitudinally extended concave surfaces on opposing sides thereof for accommodating said pair of lead wires.

2. The light socket assembly as recited in claim 1 where said rectangularly shaped end has an inwardly inclined end surface where an opening of said bore is longitudinally displaced from a rim portion of said rectangularly shaped end.

* * * * *